US008096009B2

(12) United States Patent
Shelby

(10) Patent No.: US 8,096,009 B2
(45) Date of Patent: Jan. 17, 2012

(54) ENCAPSULATED MATTRESS WITH INTEGRATED PILLOW

(75) Inventor: Timothy W. Shelby, High Point, NC (US)

(73) Assignee: MTJ American LLC, Lenoir, NC (US)

( * ) Notice: Subject to any disclaimer, the term of this patent is extended or adjusted under 35 U.S.C. 154(b) by 370 days.

(21) Appl. No.: 11/906,848

(22) Filed: Oct. 4, 2007

(65) Prior Publication Data

US 2009/0089936 A1 Apr. 9, 2009

(51) Int. Cl.
*A47C 27/14* (2006.01)

(52) U.S. Cl. ..... 5/690; 5/733; 5/657.5; 5/737

(58) Field of Classification Search ..... 5/690, 694, 5/417, 419, 413 R, 413 AM, 733, 657.5, 5/737

See application file for complete search history.

(56) References Cited

U.S. PATENT DOCUMENTS 712,720 A * 11/1902 Richardson ..... 5/712
1,648,373 A * 11/1927 Vilas ..... 5/413 R
4,087,874 A * 5/1978 Callaway et al. ..... 5/413 R
4,843,666 A * 7/1989 Elesh et al. ..... 5/723
5,548,858 A * 8/1996 Shoa ..... 5/413 R
5,640,725 A * 6/1997 Ando et al. ..... 5/413 AM
6,351,864 B1 3/2002 Karafa et al.
6,516,482 B2 2/2003 Karafa et al.
6,651,277 B1 * 11/2003 Marson ..... 5/420
6,701,558 B2 * 3/2004 VanSteenburg ..... 5/737
6,785,923 B2 * 9/2004 Karafa et al. ..... 5/733
2004/0255379 A1 * 12/2004 Zheng ..... 5/413 AM
2007/0094808 A1 * 5/2007 Jansen ..... 5/727
2008/0005845 A1 * 1/2008 Pfleger ..... 5/691

* cited by examiner

*Primary Examiner* — Michael Trettel
*Assistant Examiner* — William Kelleher
(74) *Attorney, Agent, or Firm* — Baker & Daniels LLP

(57) ABSTRACT

A method of integrating a pillow, including stuffing, within an encapsulated mattress having a core and covering surrounding the core is disclosed. A mattress for use in institutions, such as correctional facilities, detention centers, rehabilitation centers, hospitals and the like, includes a core formed of a padding material, a pillow adjoining the core, the pillow containing stuffing, and a covering surrounding the core and the pillow. Also disclosed is a mattress including a core formed of a padding material, a pillow adjoining the core using a sleeve, the pillow containing stuffing, the sleeve retaining the pillow to the core, and a covering surrounding the core and the pillow.

16 Claims, 4 Drawing Sheets

ENCAPSULATED MATTRESS WITH INTEGRATED PILLOW

BACKGROUND

The present invention relates to mattresses used in institutions, such as correctional facilities, detention centers, rehabilitation centers, hospitals and the like, and, more particularly, to mattresses that integrate a pillow including stuffing.

Institutions, such as correctional facilities, jails, penitentiaries, detention centers, rehabilitation centers, hospitals and the like, house numerous people overnight. Accordingly, these institutions typically must provide bedding for each inmate, patient or guest. Such bedding typically includes at least a mattress, and sometimes a pillow in order to provide support for the body and head during rest.

Fluid, such as water, blood, oil, urine, or other undesirable matter, such as feces, insects, bacteria, viruses, may soil the bedding requiring cleaning, sanitizing or entirely replacing the bedding at high cost in money, time, and labor. Thus it is known to encapsulate the mattress in order to keep the bedding clean.

SUMMARY

The present disclosure provides a method of integrating a pillow, including stuffing, within an encapsulated mattress having a core and covering surrounding the core. The following steps are included: adjoining the pillow with the mattress using a sleeve and encapsulating the pillow with the covering.

The present disclosure also provides a mattress including a core formed of a padding material, a pillow adjoining the core, the pillow containing stuffing, and a covering surrounding the core and the pillow.

The present disclosure also provides a mattress including a core formed of a padding material, a pillow adjoining the core using a sleeve, the pillow containing stuffing, the sleeve retaining the pillow to the core, and a covering surrounding the core and the pillow.

BRIEF DESCRIPTION OF THE DRAWINGS

The above-mentioned and other features of this invention, and the manner of attaining them, will become more apparent and the invention itself will be better understood by reference to the following description of embodiments of the invention taken in conjunction with the accompanying drawings, wherein.

Figure 1:
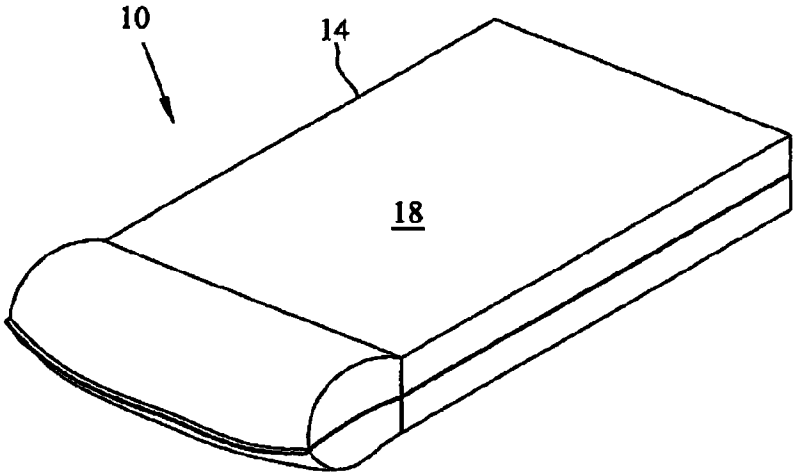
FIG. 1 is a perspective view of a mattress according to one embodiment of the present disclosure.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE EXEMPLARY EMBODIMENTS

The embodiments disclosed below are not intended to be exhaustive or limit the invention to the precise forms disclosed in the following detailed description. Rather, the embodiments are chosen and described so that others skilled in the art may utilize their teachings.

Referring to FIG. 1, mattress 10 in accordance with one embodiment of the present disclosure is illustrated. Mattress 10 includes covering 14. Covering 14 includes inner surface (not shown), which is disposed proximal to core 12 (FIG. 2) and opposing outer surface 18. Inner surface may include nylon. Outer surface 18 may include polyurethane.

Figure 2:
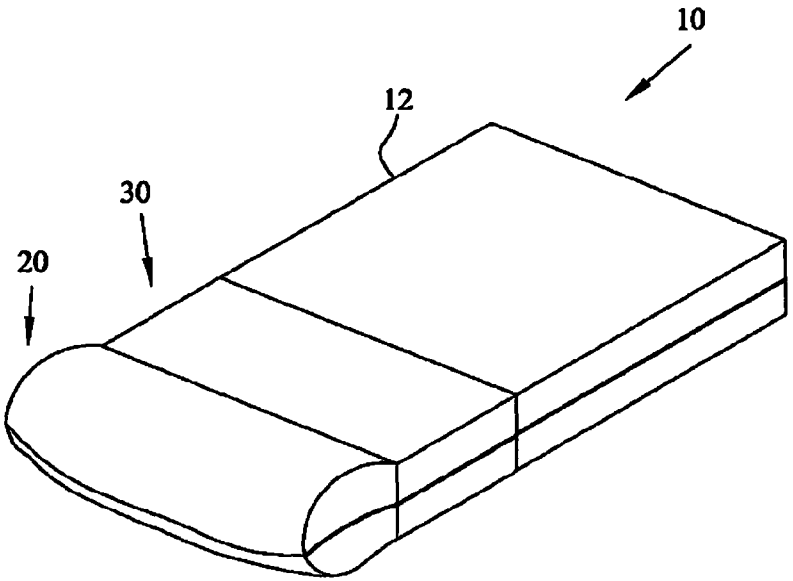
FIG. 2 is a perspective view of the mattress of FIG. 1 wherein the covering has been removed.

Covering 14 provides a barrier against fluids and other undesirable matter contacting pillow 20 (FIG. 2) or core 12 (FIG. 2). Covering 14 is also durable, extending the useable life of mattress 10. As illustrated, cover 14 encapsulates pillow 20 and core 12. Furthermore, since cover 14 encapsulates both pillow 20 and core 12, cover 14 is at least capable of adjoining pillow 20 and core 12.

Referring now to FIG. 2, mattress 10 is shown with cover 14 (FIG. 1) removed. Mattress 10 is shown including core 12, and pillow 20 adjoining core 12. Sleeve 30 is also shown adjoining pillow 20 and at least partially covering core 12. Sleeve 30 aids in adjoining pillow 20 and core 12.

Core 12 may be formed of any padding material suitable for use in mattress 10. Such padding material may include, for example, various urethane foams, densified polyester padding, silicone foam, neoprene foam, cotton padding, various batting or other mixtures thereof. The padding material may be formed using any means including, for example, vertical folding technology developed by and available from Shinih Enterprise Company Limited, Taipei, Taiwan.

As illustrated, pillow 20 may be formed of any stuffing suitable for use, including filler, foam, synthetic fills, feathers or down, or plastic. Several embodiments or ways to form pillow 20 are described in greater detail below. Several embodiments or several ways to form mattress 10 are described in patent application Ser. No. 11/811,714, filed Jun. 12, 2007, titled ENCAPSULATED AND FILTERED MATTRESS, disclosure of which is incorporated by reference herein.

Figure 3:
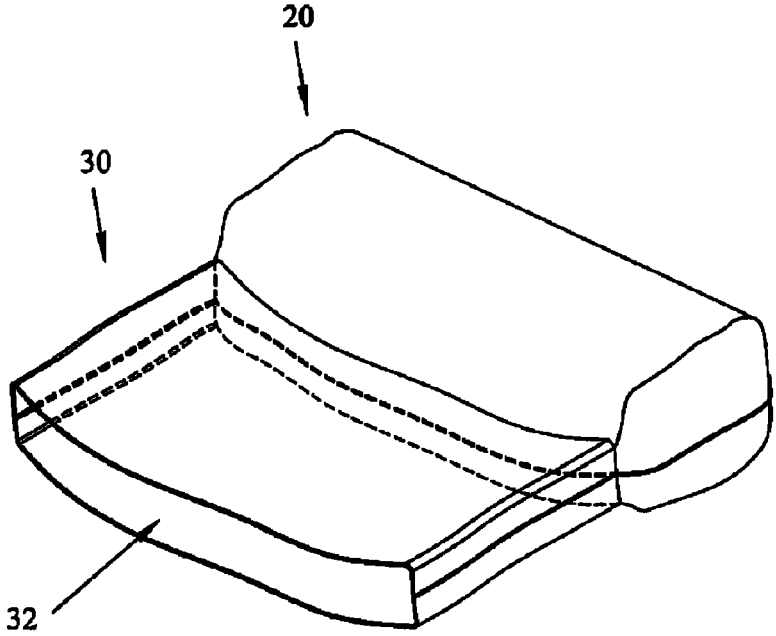
FIG. 3 is a perspective view of the pillow and sleeve of FIG. 2.

Now referring to FIG. 3, pillow 20 and sleeve 30 are illustrated. Sleeve 30 defines core cavity 32. Core cavity 32 is configured to slidably receive core 12 (FIG. 2). In this embodiment, sleeve 30 may be configured to slidably receive core 12 such that core 12 may abut pillow 20. As illustrated, sleeve 30 may be configured such that four corners of core 12 may be substantially adjoined or adjacent to pillow 20. Core cavity 32 may be defined such that at least a portion of core 12 (FIG. 2) snugly fits within sleeve 30.

Figure 4:
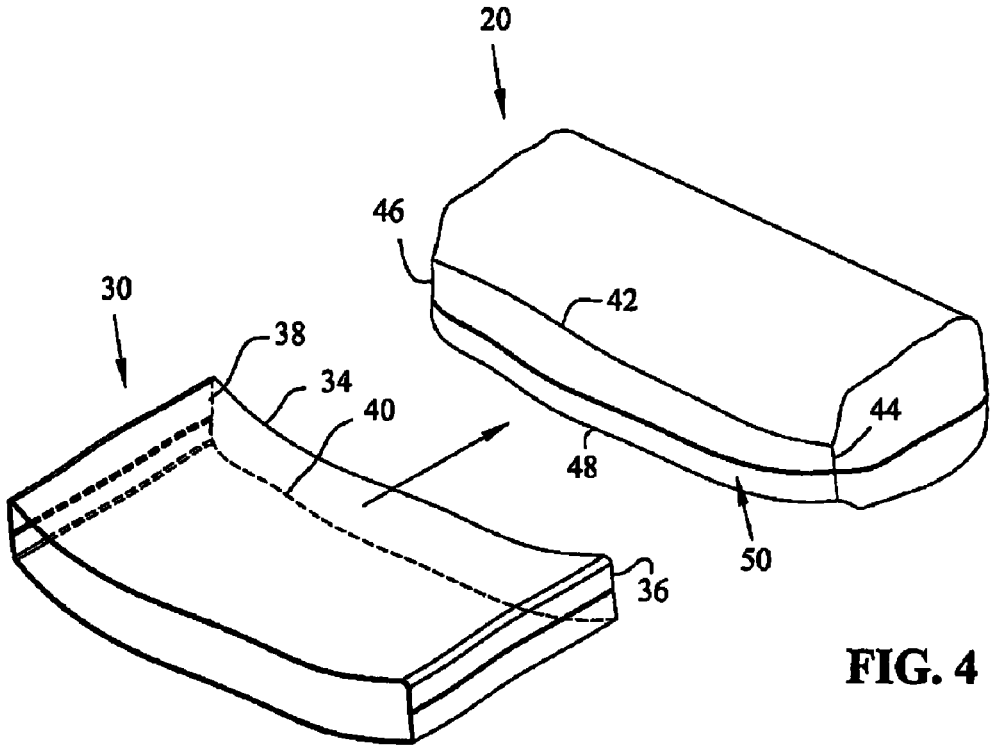
FIG. 4 is an exploded view of the pillow and sleeve of FIG. 3 according to one embodiment of the present disclosure.

Now referring to FIG. 4, in this embodiment, pillow 20 and sleeve 30 are shown prior to fastening. Pillow 20 and sleeve 30 may be fastened by numerous methods using any suitable means including, for example, heat sealing, sewing, thermal or sonic welding, adhesive bonding, and/or chemical bonding. As illustrated, sleeve 30 may be shaped to have a hollow interior and a rectangular cross-section. Furthermore, sleeve 30 may define four seaming edges 34, 36, 38, and 40. Sleeve seaming edges 34, 36, 38, and, 40 are configured to seam to pillow 20 along pillow seaming edges 42, 44, 46, and 48, respectively.

Pillow 20 may include or may define barrier portion 50. Barrier portion 50 may be integral with pillow 20. Also barrier 50 may be external to pillow 20. Barrier portion 50 provides a barrier between the interior of pillow 20 and core cavity 32 (FIG. 3). As such, barrier portion 50 prevents core 12 (FIG. 2) from being inserted within the interior of pillow 20. Furthermore, barrier portion 50 may be configured such that four corners of core 12 may be substantially adjoined or adjacent to pillow 20.

Figure 5:
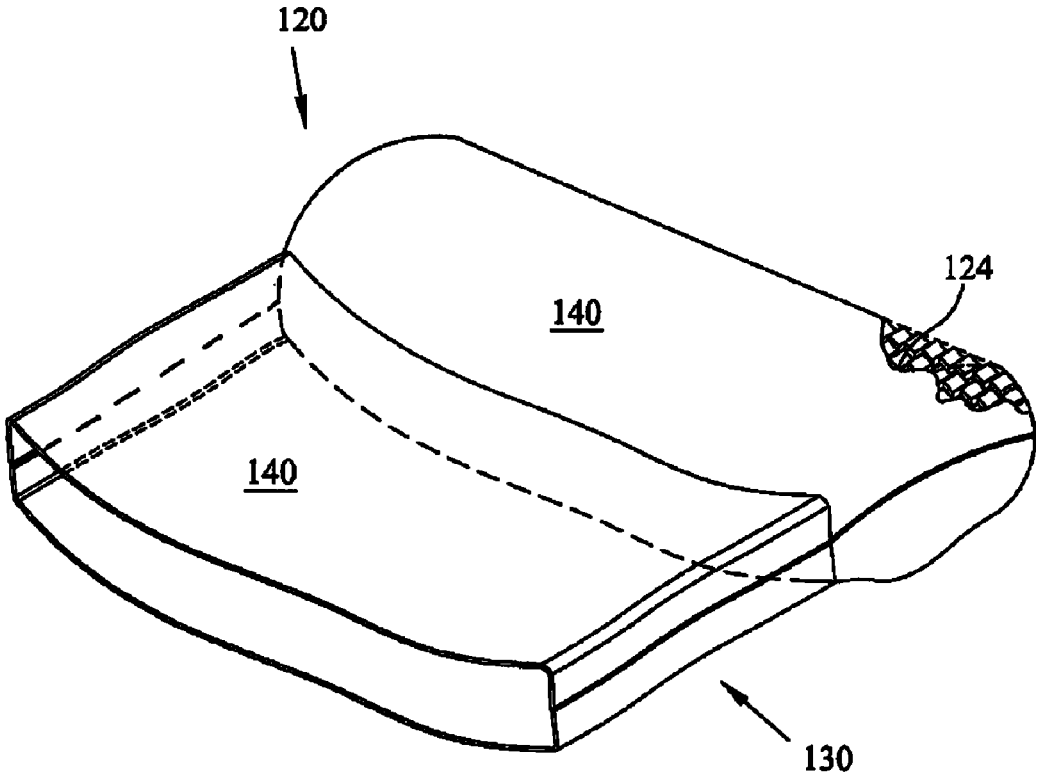
FIG. 5 is a perspective view of the pillow and sleeve of FIG. 3 according to another embodiment of the present disclosure.
Figure 6:
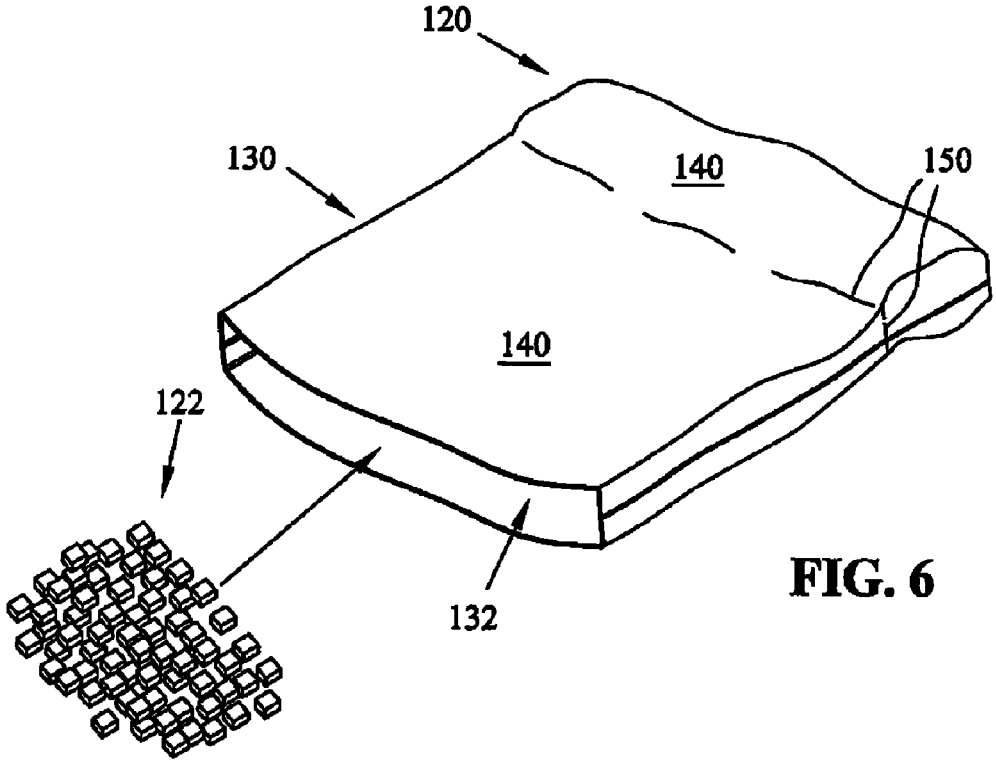
FIG. 6 is a perspective view of the pillow and sleeve of FIG. 5 wherein the barrier has not been seamed.

Another embodiment of pillow 120 and sleeve 130 is illustrated in FIG. 5. As illustrated, pillow portion 120 and sleeve portion 130 may be formed by a single piece of cloth 140. Pillow portion 120 defines a stuffing cavity 124. As shown in FIG. 6, stuffing 122 may be used to fill the stuffing cavity 124. Cloth 140 also includes sleeve portion 130. Sleeve portion 130 defines a core cavity 132 configured to receive core 12 (FIG. 2). Core cavity 132 may be configured to snugly fit core 12 (FIG. 2), allowing sleeve portion 130 to effectively attach cloth 140 to core 12 (FIG. 2).

Still referring to FIG. 6, barrier 150 separates pillow portion 120 from sleeve portion 130. Barrier portion 150 may be a suitable means of fastening cloth 140 to itself using any suitable means including, for example, heat sealing, thermal or sonic welding, adhesive bonding, and/or chemical bonding. Cloth 140 may use any suitable means including, for example, heat sealing, thermal or sonic welding, adhesive bonding, and/or chemical bonding, to create barrier 150.

Barrier 150 may include an external device used to separate stuffing cavity 124 from core cavity 132. The external barrier may be fastened to cloth 140 as part of barrier portion 150 using any suitable means including, for example, heat sealing, thermal or sonic welding, adhesive bonding, and/or chemical bonding. Similar to barrier 50, barrier portion 150 may allow core 12 (FIG. 2) to adjoin pillow portion 120.

Figure 7:
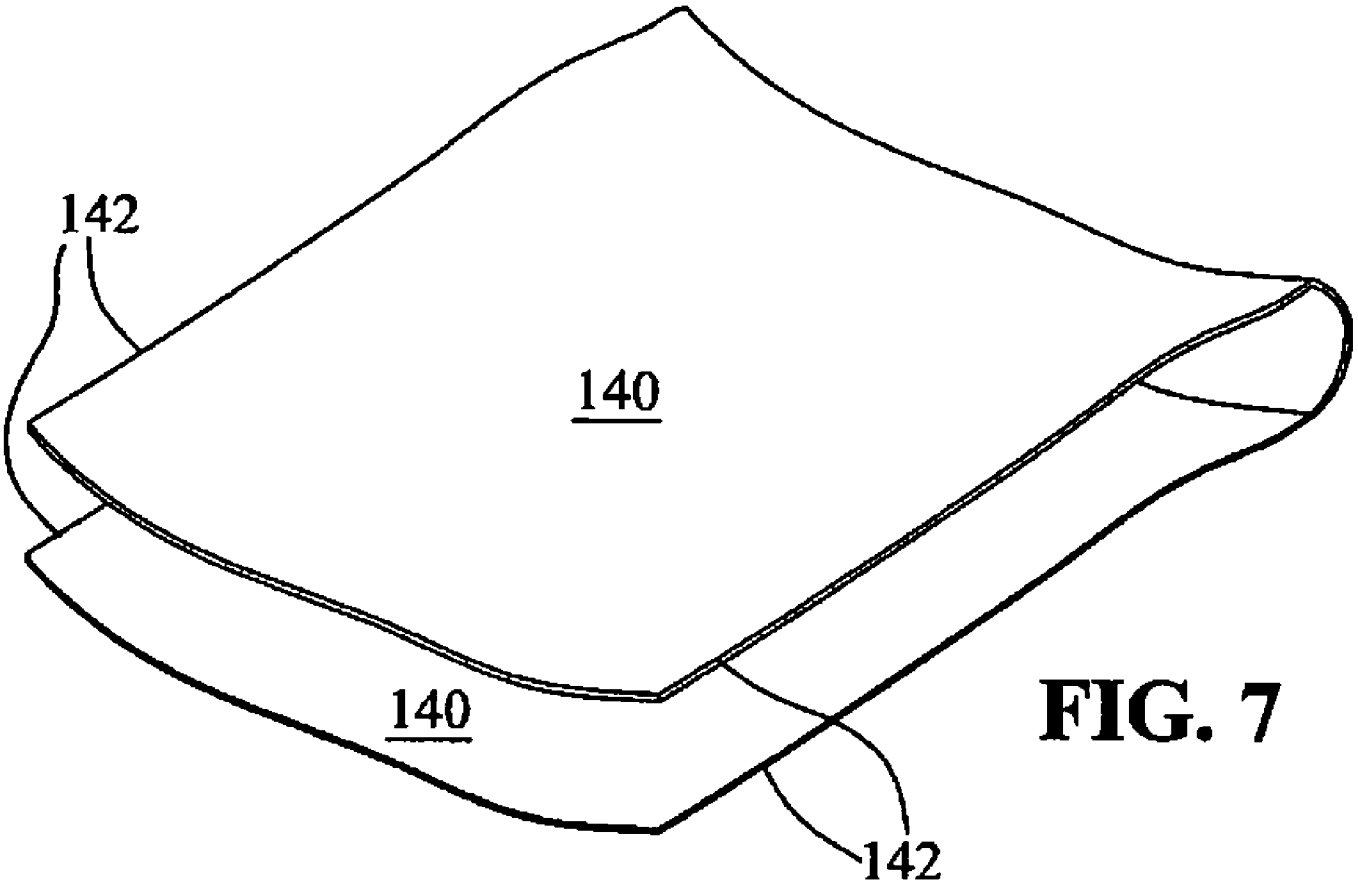
FIG. 7 is a perspective view of the pillow and sleeve of FIG. 6 wherein the cloth has not been seamed.

Now referring to FIG. 7, cloth 140 is shown including edges 142. Edges 142 may be seamed together in order to produce cloth 140 as shown in FIG. 6. Edges 142 may be seamed using any suitable means including, for example, heat sealing, thermal or sonic welding, adhesive bonding, and/or chemical bonding. In this embodiment, edges 142 may be seamed to the exterior or interior of cloth 140. In this embodiment, cloth 140 may be inverted to place seamed edges 142 to the interior or exterior of cloth 140.

FIGS. 5-7 illustrate a potential folding arrangement. FIGS. 3-4 illustrate an alternative folding arrangement. Other folding arrangements are considered and have been described as alternative folding arrangements. There are also alternative seaming or slit arrangements to facilitate alternative folding arrangements.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A mattress comprising:

a mattress sleeve, a mattress core formed of a padding material and filling said mattress sleeve to a substantial uniform thickness, the mattress core having a length greater than a length of the mattress sleeve, a pillow containing stuffing, the pillow adjoining the core, and a covering surrounding the sleeve, the core and the pillow.

2. The mattress of claim 1 wherein the sleeve is seamed to the pillow, the covering surrounding the sleeve, the sleeve retaining the pillow to the core.

3. The mattress of claim 2 wherein the sleeve covers at least a portion of the core.

4. The mattress of claim 2 wherein the sleeve includes at least one seam.

5. A mattress comprising:

a core having an upper surface and a lower surface and formed of a padding material, a pillow comprising a padding portion and having an upper surface and a lower surface, an elongate sleeve having an upper surface and a lower surface, the sleeve providing a core cavity extending from the pillow padding portion to receive at least a portion of the core, the sleeve retaining the pillow to the core, and a covering surrounding the core, the sleeve, and the pillow, the covering adjoining the upper and lower surfaces of the core, the upper and lower surfaces of the pillow, and the upper and lower surfaces of the sleeve.

6. The mattress of claim 5 wherein the pillow includes a barrier.

7. The mattress of claim 6 wherein the barrier separates the padding portion_from the sleeve.

8. The mattress of claim 5 wherein the pillow includes the sleeve, the sleeve covering at least a portion of the core.

9. The mattress of claim 1, wherein the pillow has a thickness greater than that of the core and is profiled for providing support for a neck and head.

10. The mattress of claim 1, wherein a width of the mattress sleeve is substantially identical to a width of the mattress core.

11. The mattress of claim 10, wherein the covering includes a width and a thickness substantially identical to the width and the thickness of the sleeve and the core.

12. A mattress comprising:

a core formed of a padding material;

a sleeve having an open end for receiving a stuffing material to define a pillow, the core being inserted into the sleeve and protruding from the open end of the sleeve, and the pillow extending from a length of the core; and a covering encapsulating the core, the sleeve, and the pillow.

13. The mattress of claim 12, further comprising a barrier portion positioned intermediate the stuffing of the pillow and the sleeve to separate the pillow from the core.

14. The mattress of claim 13, wherein the barrier portion is coupled to at least one of the sleeve and the pillow by sonic welding, heat sealing, sewing, thermal welding, adhesive bonding, or chemical bonding.

15. The mattress of claim 12, wherein the covering includes an inner surface comprised of nylon and an outer surface comprised of polyurethane.

16. The mattress of claim 12, wherein a material comprising the stuffing of the pillow is selected from the group consisting of foam, feathers, synthetic fills, and plastic.

* * * * *